United States Patent [19]

Heidrich

[11] Patent Number: 5,014,898

[45] Date of Patent: May 14, 1991

[54] PNEUMATICALLY OPERATED FASTENER DRIVING IMPLEMENT

[75] Inventor: Theodor Heidrich, Hemmingen, Fed. Rep. of Germany

[73] Assignee: Haubold-Kihlberg GmbH, Hemmingen, Fed. Rep. of Germany

[21] Appl. No.: 407,892

[22] Filed: Sep. 15, 1989

[30] Foreign Application Priority Data

Sep. 17, 1988 [DE] Fed. Rep. of Germany ..... 3831607

[51] Int. Cl.[5] ..... B25L 1/04

[52] U.S. Cl. ..... 227/130; 227/120; 227/156

[58] Field of Search ..... 227/130, 120, 156

[56] References Cited

U.S. PATENT DOCUMENTS 4,554,861 11/1985 Gassner et al. ..... 227/130 X
4,784,308 11/1988 Movak et al. ..... 227/130
4,821,941 4/1989 Cotta ..... 227/130

*Primary Examiner*—Paul A. Bell
*Attorney, Agent, or Firm*—Peter K. Kontler

[57] ABSTRACT

A stapler wherein the piston which drives home discrete fasteners is received in a cylinder having an open end overlapped by the valving element of a main valve. The valving element is permanently biased to sealing position by a plastic diaphragm spring and is normally held in such position by pressurized gaseous fluid which is supplied by way of a passage containing a second valve and a reciprocable second valving element close to a chamber at the outer side of the valving element of the main valve. The second valve seals the passage from a source of pressurized fluid and simultaneously establishes communication between the passage and the atmosphere in response to depression of a trigger. This results in a reduction of pressure in the passage whereby the pressurized fluid in the chamber shifts the second valving element to a position in which the chamber is free to communicate with the atmosphere at a location close to the chamber. This enables pressurized fluid to lift the valving element of the first valve and to abruptly propel the piston in a direction to drive a fastener into one or more objects.

16 Claims, 4 Drawing Sheets

Fig. 4
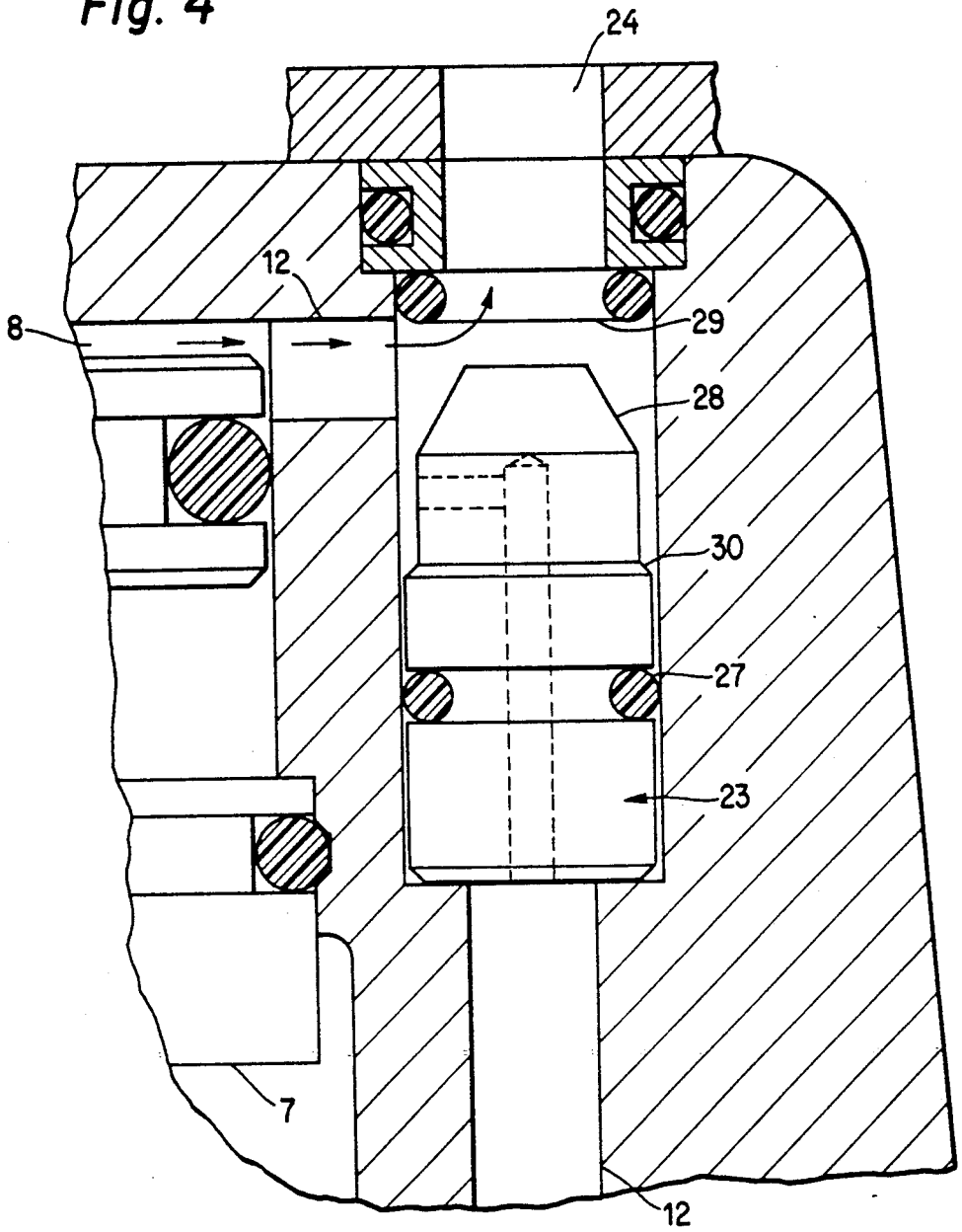
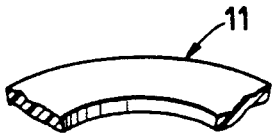
Fig. 5a
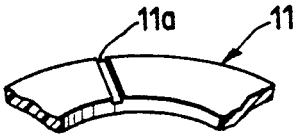
Fig. 5b
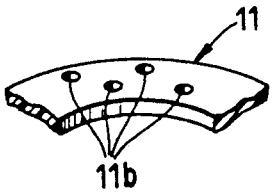
Fig. 5c

PNEUMATICALLY OPERATED FASTENER DRIVING IMPLEMENT

BACKGROUND OF THE INVENTION

The invention relates to improvements in staplers and analogous implements. More particularly, the invention relates to improvements in pneumatically operated implements for driving staples, nails and/or other types of fasteners.

It is already known to provide an implement of the above outlined character with a cylinder for a reciprocable piston which can propel a fastener into a workpiece or the like in response to abrupt movement from one toward the other end of the cylinder as a result of admission of pressurized gaseous fluid (normally air) into the one end of the cylinder. It is further known to equip such implements with a main valve having a valving element which overlies the one end of the cylinder and is biased to sealing position by a spring. That (one) side of the valving element which faces away from the one end of the cylinder is normally acted upon by pressurized fluid which assists the spring in maintaining the valving element in sealing position. The flow of fluid in a channel which connects a chamber at the one side of the valving element with a source of pressurized fluid is controlled by a second valve which is remote from the chamber and can be actuated by a trigger to seal the channel from the source of pressurized fluid and to simultaneously or thereafter connect the channel with the atmosphere. This results in a reduction of pressure in the chamber and enables pressurized fluid, which acts against another side of the valving element opposite the one side, to overcome the bias of the spring and to move the valving element to an open or inoperative position. Pressurized fluid is then free to penetrate into the one end of the cylinder and to propel the piston in a direction to drive a fastener into an object or into two or more abutting or overlapping objects.

It is further known to design the source of pressurized fluid in such a way that pressurized fluid is free to penetrate into the one end of the cylinder all the way around the one end, as soon as the valving element of the main valve is caused to assume its inoperative position. This entails a more uniform application of fluid pressure to each portion of the piston and more predictable propulsion of the piston toward the other end of the cylinder. Moreover, such mode of regulating the admission of pressurized fluid into the one end of the cylinder is intended to promote rapid acceleration of the piston and to thus increase the force with which the piston propels a fastener into one or more objects when it approaches or reaches the end of the working stroke. The arrangement is normally such that the valving element of the main valve constitutes a relatively large lid which overlies the one end of the cylinder and can perform strokes in the range of several millimeters.

A drawback of the just described conventional implement is that the path for evacuation of fluid from the chamber at the one side of the valving element of the main valve to the locus of discharge into the atmosphere is very long and normally includes numerous arcuate portions. All this contributes to a pronounced resistance to the flow of fluid from the chamber into the atmosphere and prevents pressurized fluid in the source from rapidly moving the valving element to its inoperative position. Therefore, the initial acceleration of the piston in response to movement of the valving element from the sealing position is unsatisfactory and the force which the piston applies to a fastener at the end of its stroke is often insufficient.

The aforementioned spring opposes the movement of the valving element to the inoperative position. Nevertheless, such spring is necessary and desirable because it reduces the likelihood of injury to a user of the implement. Thus, the spring ensures that the valving element of the main valve assumes its operative position when the implement is not in use as well as when the source of pressurized fluid in the housing of the implement is connected to an outside source of pressurized fluid, particularly by way of a hose or another suitable conduit.

Another drawback of conventional implements is that the useful life of their springs is rather short. This is due to repeated stressing of the springs and to repeated dissipation of energy. A broken spring is likely to cause injury and/or partial or complete destruction of adjacent parts of the implement.

OBJECTS OF THE INVENTION

An object of the invention is to provide a pneumatically operated implement, such as a stapler, wherein a fastener can be driven into one or more objects with a force greatly exceeding that which can be generated by the piston in a conventional implement.

Another object of the invention is to provide the implement with novel and improved means for venting the chamber which is adjacent the valving element of the main valve.

A further object of the invention is to provide an implement wherein the fluid which is to be expelled from the housing preparatory to and during driving of a fastener must cover a shorter distance and encounters less resistance than in a conventional implement.

An additional object of the invention is to provide a novel and improved spring for use in the above outlined implement.

Still another object of the invention is to provide a spring whose useful life is longer than that of conventional springs.

A further object of the invention is to provide a novel and improved method of venting the chamber adjacent the valving element in the main valve of the above outlined implement.

Another object of the invention is to provide an implement which is safer than heretofore known implements.

An additional object of the invention is to provide an implement which can drive fasteners with a great force and in practically instantaneous response to actuation of the trigger.

SUMMARY OF THE INVENTION

The invention is embodied in a pneumatically operated implement which can be used to drive staples, nails or other fasteners into paper, wood, concrete or other materials. The improved implement comprises a housing, a cylinder which is provided in the housing and has an open first end and a second end, a piston which is reciprocable in the cylinder and has means (such as an elongated rod, strip or bar which extends through and beyond the second end of the cylinder) for driving a fastener home in response to movement of the piston from the first toward the second end of the cylinder, a main valve including a (first) valving element which is adjacent the first end of the cylinder and is movable in the housing between operative and inoperative positions in which the first end of the cylinder is respectively sealed and exposed, means (such as a substantially ring-shaped spring which can be said to form part of the main valve) for biasing the first valving element to the operative position, a source of pressurized gaseous fluid which is provided in the housing and acts upon a first surface of the first valving element in a direction to move the first valving element to the inoperative position with attendant penetration of pressurized fluid into the cylinder and resulting in abrupt propulsion of the piston toward the second end of the cylinder, a second surface provided on the first valving element substantially opposite the first surface and being disposed in a chamber of the housing, a system of conduits or other suitable means for connecting the source of pressurized fluid to the chamber so that the fluid in the chamber assists the biasing means in maintaining the first valving element in the operative position while the fluid also exerts pressure upon the first surface of the first valving element, and means for establishing (when necessary) communication between the chamber and the atmosphere in a region which is preferably closely adjacent the chamber to thus reduce the pressure in the chamber and hence the pressure of fluid upon the second surface and enable the fluid acting upon the first surface to move the first valving element to the inoperative position against the opposition of the biasing means.

The means for establishing communication preferably includes a second valving element which is installed in a preferably cylindrical portion of the connecting means and is movable (preferably reciprocable) therein between a first position in which the source of pressurized fluid is free to admit fluid into the chamber (i.e., in which the second valving element does not oppose the flow of pressurized fluid from the source to the chamber) and a second position in which the chamber is free to communicate with the atmosphere so that the pressure of fluid upon the second surface of the first valving element drops and the pressure acting upon the first surface suffices to move the first valving element to its inoperative position.

The implement further comprises means for moving (or permitting a movement of) the second valving element between its first and second positions. Such moving means preferably includes a third valving element which is disposed in the connecting means between the source of pressurized fluid and the aforementioned portion of the connecting means (i.e., between the source and the second valving element), and means (e.g., a coil spring) for moving the third valving element to a predetermined position in which the source communicates with the aforementioned portion of the connecting means and the fluid is free to maintain the second valving element in the first position (in which the chamber is free to receive pressurized fluid but is sealed from the atmosphere). Such implement preferably further comprises means (e.g., a manually operated trigger) for moving the third valving element from the predetermined position to an additional position in which the third valving element seals the connecting means from the source of pressurized fluid and establishes communication between the connecting means and the atmosphere so that the second valving element is free to leave the first position (preferably in response to the pressure of fluid in the chamber).

The aforementioned portion of the connecting means preferably includes or defines a substantially cylindrical compartment for the second valving element, and the latter is preferably provided with a channel which connects the source of pressurized fluid with the chamber in the first position of the second valving element (and in the predetermined position of the third valving element). The housing is provided with at least one port which connects the chamber with the atmosphere in the second position of the second valving element. The latter preferably comprises a cylindrical portion with a circumferential groove for a sealing member (e.g., an O-ring) which engages the connecting means in the compartment. As mentioned above, the second valving element is preferably mounted for reciprocatory movement between its first and second positions. The connecting means and the second sealing element preferably define an annular space which forms part of the compartment and communicates with the chamber. The channel of the second valving element communicates with the port or ports of the housing in the second position of the second valving element and communicates with the annular space at least in the first position of the second valving element. The port or ports are preferably disposed at one axial end of the compartment, and the implement preferably further comprises an annular sealing member which is disposed in the compartment and surrounds the port or ports of the housing. The second valving element can be provided with a substantially frustoconical end portion which sealingly engages the annular sealing member in the first position of the second valving element to thereby seal the port or ports from the chamber.

The connecting means can include a sleeve which surrounds the second valving element in the compartment of the connecting means.

The aforementioned third valving element preferably forms part of a second valve which is provided in the connecting means between the source of pressurized fluid and the compartment of the connecting means and is operable to connect the compartment with the source or with the atmosphere. The second valving element can be provided with a peripheral shoulder or with another suitable source which is acted upon by fluid in the chamber to abruptly shift the second valving element to the second position as soon as the second valve connects the compartment with the atmosphere.

As stated above, the biasing means of the first valve preferably comprises a ring-shaped washer-like spring, e.g., a diaphragm spring. At least a portion of such ring-shaped spring can be made of a plastic material, such as polyurethane. A certain part of the ring-shaped spring reacts against a part of the housing to thereby urge the first valving element to its operative position, and at least one of these parts can be provided with one or more grooves which can extend substantially radially of the ring-shaped spring to reduce the likelihood of adherence of the spring to the housing. The at least one groove can be provided in the aforementioned part of the spring. Alternatively, or in addition to at least one groove, the spring can be provided with one or more through bores or holes.

The novel features which are considered as characteristic of the invention are set forth in particular in the appended claims. The improved implement itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 4 illustrates the structure of FIG. 3 but with the second valving element shown in an elevational view and in the second position in which the chamber is communicatively connected with the atmosphere;

FIG. 5*a* is a fragmentary perspective view of a first embodiment of the biasing means for the first valving element;

FIG. 5*b* is a different fragmentary perspective view of modified biasing means with one or more radially extending grooves in that part which contacts the housing; and FIG. 5*c* is a similar fragmentary perspective view of third biasing means.

DESCRIPTION OF PREFERRED EMBODIMENTS

Figure 1:
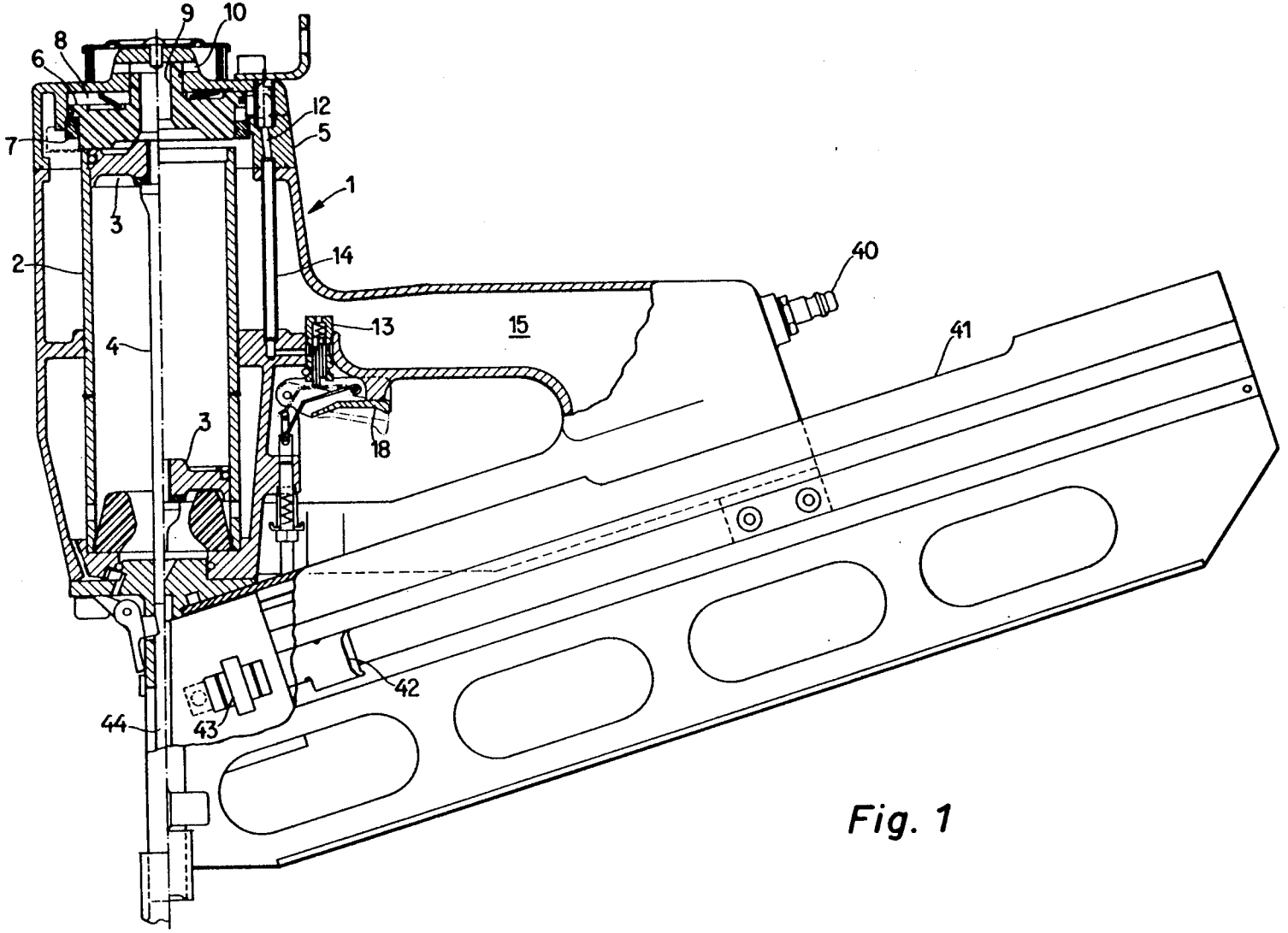
FIG. 1 is a schematic partly elevational and partly central sectional view of a pneumatically operated stapler, nail driver or analogous implement which embodies one form of the invention.
Figure 2:
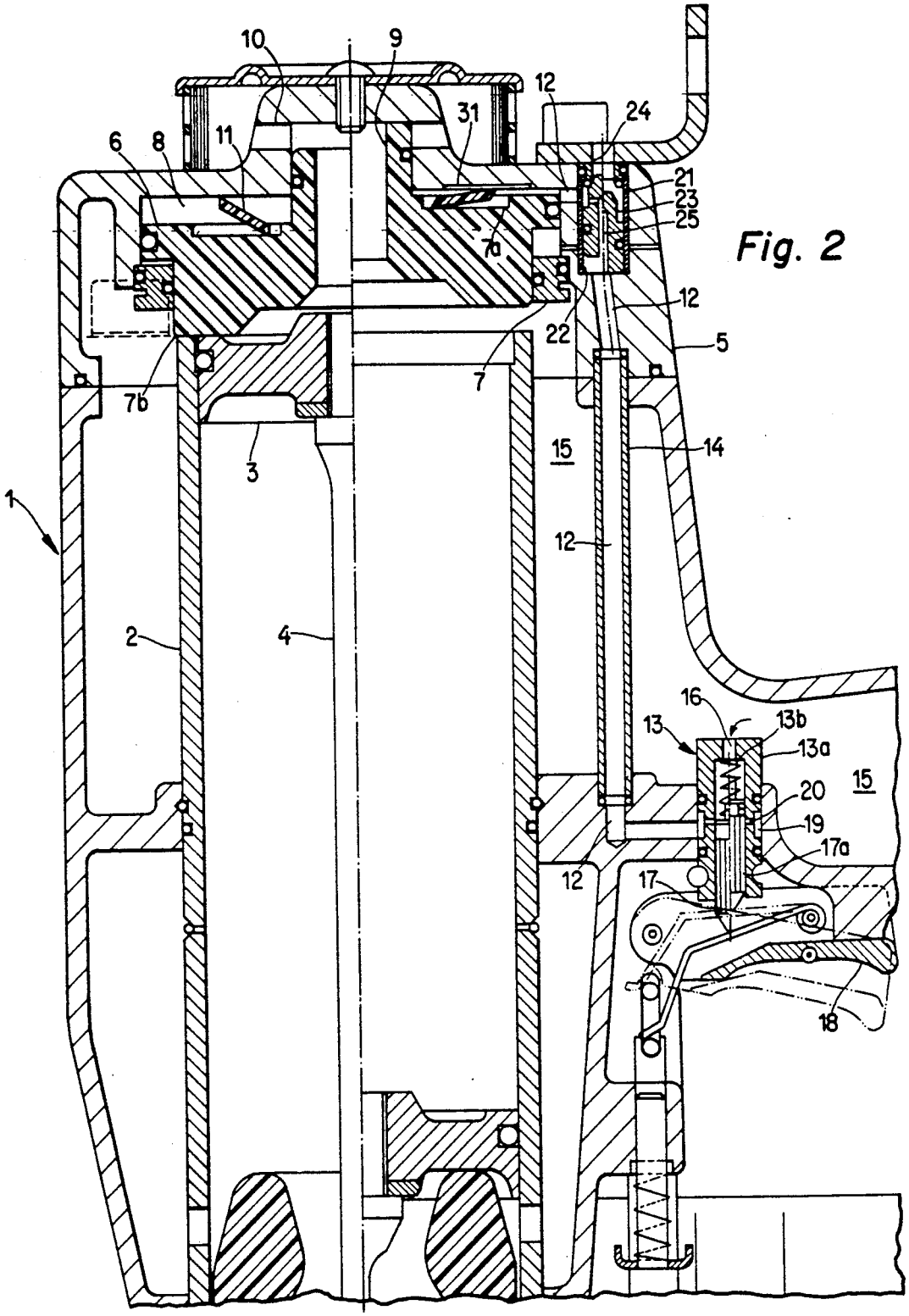
FIG. 2 is a greatly enlarged view of a detail in the implement of FIG. 1, showing the cylinder, the piston and the three valving elements, one-half of each valving element being shown in a first end position and the other half of each valving element being shown in a second end position.

The implement which is shown in FIGS. 1 and 2 comprises a housing 1 having an upper portion or head for a cylinder 2. A piston 3 is reciprocable in the cylinder 2 between a first end position which is shown in the left-hand portion of the cylinder of FIGS. 1 and 2 and a second end position which is shown in the right-hand portion of the cylinder. The piston 3 includes an elongated bar-, strip- or rod-shaped extension 4 which constitutes a means for driving a fastener (e.g., a staple or a nail) into a piece of wood, concrete, plastic, paper or the like. The extension 4 projects through and beyond the lower end of the cylinder 2 (as seen in FIGS. 1 and 2) and can expel discrete fasteners from a channel 44 in front of a magazine 41 for a supply of fasteners. A spring 43 is anchored in the magazine 41 and carries a pusher 42 which bears against the rearmost fastener of a file or row of fasteners in the magazine to thereby urge the foremost fastener of the file or row into the adjacent portion of the channel 44. The exact construction of the magazine 41, of the manner of refilling the magazine with fasteners and of the manner of securing the spring 43 to the magazine forms no part of the present invention. The exact design of the magazine will depend upon the nature and/or size of fasteners which are to be driven into workpieces or into other objects in response to propulsion of the piston 3 from the first or retracted position to the second or extended position.

The head of the housing 1 includes a cupped cover 5 which overlies a main valve including a (first) valving element 6 which overlies the adjacent open end of the cylinder 2 and is movable in a chamber 8 of the housing 1 between an operative or sealing position (see particularly the left-hand portion of FIG. 2) and an inoperative or retracted position (best seen in the right-hand portion of FIG. 2) in which the open end of the cylinder 2 communicates with a source 15 of pressurized gaseous fluid (normally compressed air). The valving element 6 is reciprocable within an annular insert 7 and is also guided by a portion of the cover 5. The chamber 8 establishes room for movements of the valving element 6 between its operative and inoperative positions and contains a ring-shaped or washer-like spring 11 (e.g., a diaphragm spring) which serves as a means for permanently but yieldably biasing the valving element 6 to its operative position. Fluid which is confined in the space between the piston 3 and the valving element 6 can escape from the housing 1 by way of a centrally located aperture 9 in the form of a bore or hole which is free to communicate with the atmosphere via channels 10 in the cover 5 when the valving element 6 assumes its operative position. The aperture 9 is sealed from the channels 10 in the inoperative position of the valving element 6. The piston 3 expels fluid from the space within the cylinder 2 when it moves from the lower to the upper end position of FIG. 1 or 2 under the action of a spring or the like, not shown.

The chamber 8 can communicate with an elongated channel or passage 12 in a connecting means 14 when a second valving element 23 in a cylindrical portion 21 of the passage 12 permits the source 15 to admit pressurized fluid by way of a composite channel 25, 25*a* in the second valving element 23. The flow of fluid from the source 15 to the chamber 8 is further controlled by a 13. This second valve can be said to constitute a means for moving the valving element 23 between a first position (shown in FIG. 3), in which the composite channel 25, 25*a* of this valving element establishes a path for the flow of pressurized fluid into the chamber 8, and a second position (shown in FIG. 4) in which the valving element 23 establishes a path for the flow of pressurized fluid from the chamber 8 into the atmosphere by way of a port 24 which is provided in the cover 5 of the housing 1 at the upper or outer axial end of the cylindrical portion or compartment 21 of the channel 12. The source 15 can receive a fresh supply of pressurized fluid by way of a nipple 40 which is connected to an air compressor or the like (not shown) by way of a flexible hose (not shown) or in any other suitable way. The magazine 41 is normally located at a level beneath the source 15 which latter occupies a substantial part of the housing 1. The magazine 41 can constitute a detachable component which is separably affixed to the housing 1, especially if it can be more readily refilled with fasteners when it is not secured to the housing. The pusher 42 can be provided with a customary handgrip portion of the type used in many staplers to permit its retraction prior to insertion of a fresh supply of fasteners, e.g., a series of coherent staples.

The second valve 13 comprises a cylindrical body 13*a* with a hole 16 which establishes communication between the source 15 and the interior of the body 13*a*. The (third) valving element 17 is reciprocable in the body 13*a* and is provided with axially parallel peripheral grooves or flutes 17*a* to permit evacuation of compressed fluid from the passage 12 of the connecting means 14 when the valving element 17 is lifted by a manually operable trigger 18. A coil spring 13*b* is installed in the body 13*a* to permanently bias the valving element 17 to a predetermined position (shown in the left-hand portion of the body 13*a* in which the hole 16 admits pressurized fluid into radial bores 20 provided in the body 13*a* around the valving element 17 and communicating with an annular groove 19. The latter, in turn, communicates with the passage 12 of the connecting means 14. When the trigger 18 is actuated (pivoted clockwise as seen in FIG. 2), it causes the valving element 17 to move to an additional position (shown in the right-hand portion of the body 13*a*) in which the hole 16 is sealed from the passage 12 but the latter communicates with the peripheral flutes 17*a* which permit escape of pressurized fluid from the passage 12 into the atmosphere. Communication between the passage 12 and the flutes 17*a* in the additional position of the valving element 17 is established by way of the annular groove 19 and the radial bores 20 of the body 13*a*.

Figure 3:
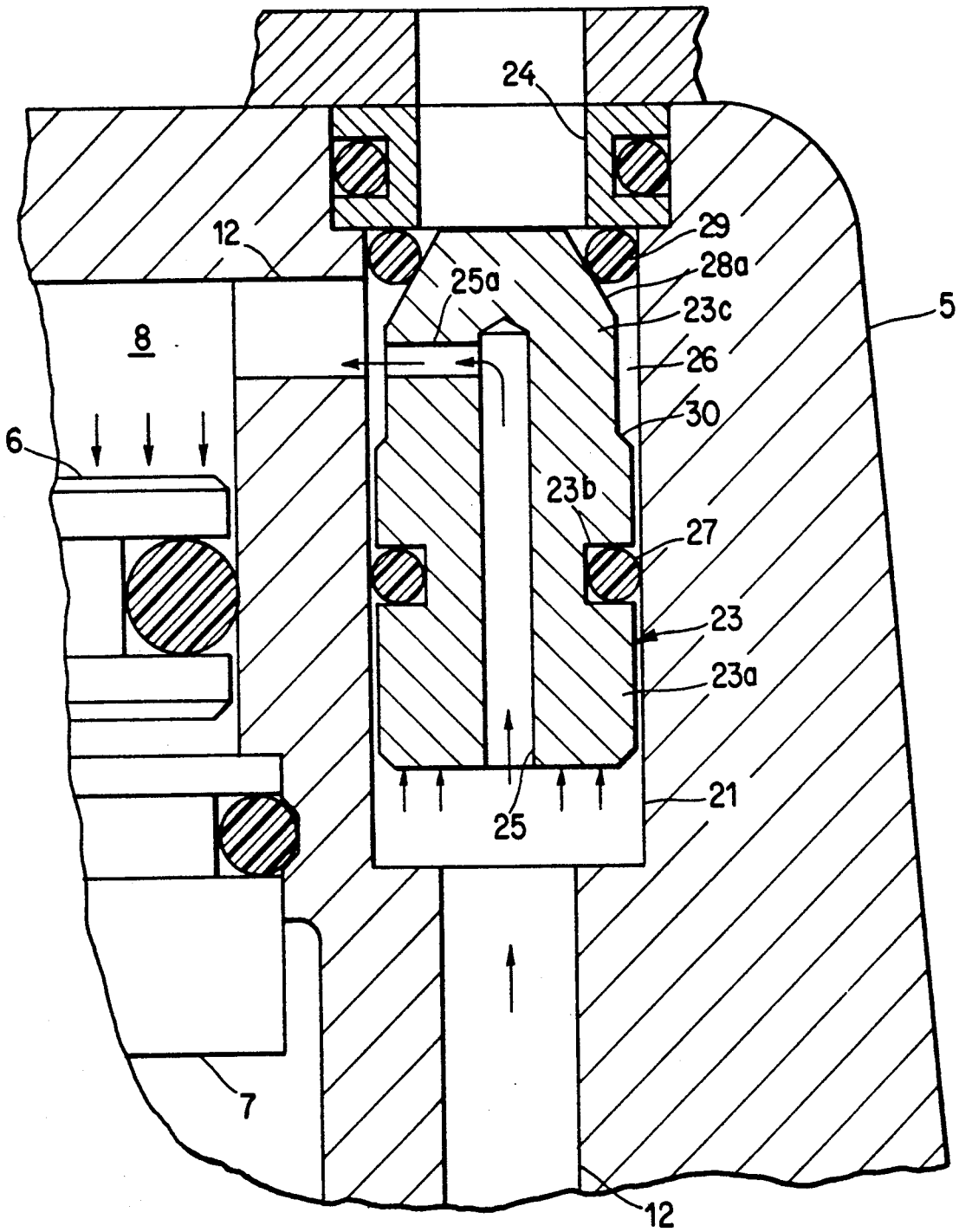
FIG. 3 is a greatly enlarged view of a detail in FIG. 2, showing the second valving element in the first position in which the chamber adjacent the first valving element is sealed from the atmosphere.

FIG. 2 shows that the compartment 21 can receive a cylindrical sleeve 22 which surrounds and guides the second valving element 23 for reciprocatory movement between the first position of FIG. 3 and the second position of FIG. 4. The valving element 23 includes a maximum- or larger-diameter portion 23*a* which is formed with a circumferential groove 23*b* for an annular sealing member 27 (e.g., an O-ring). The latter prevents leakage of pressurized fluid between the main portion of the channel 12 (beneath the compartment 21) and an annular space 26 which is defined by the surface surrounding the compartment 21 and a smaller-diameter portion 23*c* of the valving element 23. The valving element 23 further includes a frustoconical outer end portion 28*a* which cooperates with an annular sealing member 29 to seal the port 24 from the chamber 8 when the valving element 23 is caused to assume the first position of FIG. 3. The sealing member 29 (e.g., an O-ring) is installed in the respective end portion of the compartment 21 and surrounds the port 24. Additional sealing members are installed in the cover 5 and in the valving element 6 to prevent uncontrolled leakage of pressurized fluid and/or uncontrolled inflow of atmospheric air.

The composite channel 25, 25*a* of the valving element 23 is in permanent communication with the major portion of the passage 12 in the connecting means 14 and is also in permanent communication with the annular space 26. The latter is or can be in permanent communication with the chamber 8 and communicates with the port 24 in the second position (FIG. 4) of the valving element 23.

The valving element 23 is further provided with an annular shoulder or surface 30 which is acted upon by pressurized fluid in the annular space 26 when the frustoconical end portion 28*a* bears against the sealing member 29 to seal the port 24 from the chamber 8. When the trigger 18 is actuated to lift the valving element 17 of the second valve 13, the pressure in the main portion of the passage 12 drops (because such main portion of the passage 12 is communicatively connected with the atmosphere via groove 19, bores 20 and flutes 17*a*) and the fluid acting upon the shoulder 30 is then free to move the valving element 23 axially from the position of FIG. 3 to the position of FIG. 4. This permits abrupt establishment of communication between the chamber 8 and the atmosphere via port 24 of the cover 5.

The first valving element 6 is maintained in the operative position (shown in the left-hand portion of FIG. 2) when the second valving element 23 assumes the position of FIG. 3. At such time, the spring 13*b* of the second valve 13 maintains the third valving element 17 in the predetermined position (shown in the left-hand portion of the body 13*a* in FIG. 2) in which pressurized fluid is free to flow from the source 15, via hole 16, bores 20, groove 19, passage 12, composite channel 25, 25*a* of the second valving element 23, annular space 26 and into the chamber 8. Pressurized fluid in the chamber 8 acts upon the adjacent surface 7*a* of the valving element 6 and maintains the latter in sealing engagement with the open end of the cylinder 2. The frustoconical portion 28*a* of the valving element 23 seals the port 24 from the annular space 26 (i.e., from the chamber 8), and the flutes 17*a* of the valving element 17 are sealed from the passage 12 (i.e., from the groove 19).

If the operator wishes to drive a fastener into a workpiece, the discharge end of the channel 44 is properly oriented with reference to the workpiece and the trigger 18 is actuated to lift the valving element 17 against the opposition of the coil spring 13*b*. This enables the valving element 17 (and more particularly its flutes 17*a*) to establish communication between the passage 12 and the atmosphere while the passage 12 is sealed from the source 15. The pressure of fluid in the chamber 8 and in the annular space 26 is sufficiently high to displace the annular shoulder 30 of the valving element 23 so that the latter is shifted from the position of FIG. 3 to the position of FIG. 4. The frustoconical portion 28*a* moves away from the sealing member 29 and the pressure in the chamber 8 drops abruptly because the chamber 8 is free to communicate with the atmosphere by way of the annular space 26 and port 24. The pressurized fluid in the source 15 is then free to abruptly lift the valving element 6 to the inoperative position which is shown in the right-hand portion of FIG. 2 so that a large quantity of pressurized fluid penetrates into the upper portion of the cylinder 2. The piston 3 is propelled toward the lower end of the cylinder 2 and its extension 4 drives a fastener into a workpiece which is adjacent the lower end of the channel 44. Fluid in the source 15 is free to act against a circumferentially complete surface 7*b* of the valving element 6 in a direction to lift this valving element in the chamber 8 and to cause the spring 11 to store energy.

When the trigger 18 is released, the spring 13*b* returns the valving element 17 to its predetermined position in which the source 15 communicates with the passage 12 of the connecting means 14. Pressurized fluid acts upon the lower end face of the valving element 23 and causes this valving element to reassume the position of FIG. 3. This enables the composite channel 25, 25*a* to convey pressurized fluid from the major portion of the passage 12 into the annular space 26 and thence into the chamber 8 so that the valving element 6 reassumes its operative position in which the open end of the cylinder 2 is sealed from the source 15. A portion of this source preferably surrounds the entire open end of the cylinder 2. As already mentioned above, the implement is or can be equipped with a spring or with other suitable means for moving the piston 3 back to its retracted position whereby the piston expels air from the cylinder 2 by way of the aperture 9 and channels 10.

An advantage of the illustrated ring-shaped or washer-like spring 11 is that its useful life is longer than that of many other springs (such as coil springs). This spring can be made, at least in part, of a suitable plastic material, for example, polyurethane. Such springs can readily stand repeated stresses for long periods of time, longer than many metallic springs. The likelihood of breakage of a plastic diaphragm spring or an analogous washer-like spring is very remote in spite of the abruptness of movements of valving element 6 between its operative and inoperative positions.

In order to prevent adherence of the upper side of the spring 11 to the underside of the top portion of the cover 5 (e.g., due to suction), the upper side of the spring 11 and/or the underside of the top part of the cover 5 is preferably provided with one or more grooves which extend substantially radially of the spring. FIG. 5*b* shows a single groove 11*a* in a portion of the spring 11. In addition to or in lieu of the groove or grooves 11*a*, the spring 11 can be provided with one or more through bores or holes 11*b* (see FIG. 5*c*) which serve the same purpose as the groove or grooves 11*a*. A groove at the underside of the top portion of the cover 5 is shown in FIG. 2, as at 31. If the cover 5 is formed with one or more grooves 31, the implement can employ a simple spring 11 (FIG. 5*a*) which is devoid of one or more grooves 11*a* and/or one or more bores or holes 11*b*.

An advantage of the improved implement is that the first valving element 6 can be abruptly moved to the inoperative position in practically instantaneous response to actuation of the trigger 18. This is due to the fact that the port 24 is closely adjacent the chamber 8 for the valving element 6 so that the pressure of fluid in the chamber 8 can drop practically simultaneously with actuation of the trigger 18, i.e., as soon as the pressure in the main portion of the passage 12 drops sufficiently to enable pressurized fluid in the source 15 to lift the valving element 6 off the open end of the cylinder 2. The latter is then ready to receive a large quantity of pressurized fluid which propels the piston 3 toward the other end of the cylinder (where the piston can rebound on impact against a suitable cushion) and the extension 4 expels a fastener from the channel 44 in front of the magazine 41.

The second valving element 23 is moved to the position of FIG. 4 as soon as the pressure of fluid in the main portion of the passage 12 drops because the pressure of fluid which fills the chamber 8 and in the annular space 26 and acts upon the shoulder 30 suffices to propel the valving element 23 away from the port 24. The path for the escape of fluid from the chamber 8 into the atmosphere via port 24 is very short so that the escaping fluid encounters minimal resistance and enables pressurized fluid in the source 15 to rapidly lift the valving element 6 off the open end of the cylinder 2. It has been found that lifting of the valving element 6 takes place much more rapidly than in conventional implements wherein the length of the path from the chamber to the venting means is many times the length of the path from the chamber 8 to the port 24 in the implement of the present invention.

An additional important advantage of the improved implement is that the acceleration of the piston 3 on its way from the open end toward the other end of the cylinder 2 is much more rapid than in heretofore known implements. The reason is that the valving element 6 is abruptly lifted off the cylinder 2 and admits a large quantity of pressurized fluid which acts upon the respective side of the piston 3 and propels it toward the other end of the cylinder. Therefore, the maximum speed of the piston 3 is higher than in heretofore known implements. Such maximum speed determines the magnitude of the force with which the extension 4 drives a fastener into one or more objects.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A pneumatic implement for driving staples, nails and analogous fasteners, comprising a housing: a cylinder provided in said housing and having an open first end and a second end; a piston reciprocable in said cylinder and having means for driving a fastener in response to movement of the piston from said first toward said second end; a valve including a valving element adjacent said first end and movable in said housing between operative and inoperative positions in which said first end is respectively sealed and exposed, and means for biasing said element to said operative position, said biasing means comprising a ring-shaped spring and at least a portion of said spring consisting of polyurethane; a source of pressurized gaseous fluid, said element having a first surface which is acted upon by fluid to move said element to said inoperative position with attendant penetration of fluid into said cylinder and propulsion of said piston toward said second end, said element further having a second surface substantially opposite said first surface and said housing having a chamber adjacent said second surface; means for connecting said source to said chamber so that the fluid in said chamber assists said biasing means to maintain said element in said operative position; and means for establishing communication between said chamber and the atmosphere adjacent said chamber to thus reduce the pressure in said chamber and enable the fluid acting upon said first surface to move said element to said inoperative position.

2. A pneumatic implement for driving staples, nails and analogous fasteners, comprising a housing; a cylinder provided in said housing and having an open first end and a second end; a piston reciprocable in said cylinder and having means for driving a fastener in response to movement of the piston from said first toward said second end; a valve including a valving element adjacent said first end and movable in said housing between operative and inoperative positions in which said first end is respectively sealed and exposed, and means for biasing said element to said operative position, said biasing means comprising a ring-shaped spring and a portion of said spring reacting against a portion of said housing, at least one of said portions having at least one groove extending substantially radially of said spring; a source of pressurized gaseous fluid, said element having a first surface which is acted upon by fluid to move said element to said inoperative position with attendant penetration of fluid into said cylinder and propulsion of said piston toward said second end, said element further having a second surface substantially opposite said first surface and said housing having a chamber adjacent said second surface; means for connecting said source to said chamber so that the fluid in said chamber assists said biasing means to maintain said element in said operative position; and means for establishing communication between said chamber and the atmosphere adjacent said chamber to thus reduce the pressure in said chamber and enable the fluid acting upon said first surface to move said element to said inoperative position.

3. The implement of claim 2, wherein said at least one groove is provided in said spring.

4. A pneumatic implement for driving staples, nails and analogous fasteners, comprising a housing; a cylinder provided in said housing and having an open first end and a second end; a piston reciprocable in said cylinder and having means for driving a fastener in response to movement of the piston from said first toward said second end; a valve including a valving element adjacent said first end and movable in said housing between operative and inoperative positions in which said first end is respectively sealed and exposed, and means for biasing said element to said operative position, said biasing means comprising a ring-shaped spring having at least one bore; a source of pressurized gaseous fluid, said element having a first surface which is acted upon by fluid to move said element to said inoperative position with attendant penetration of fluid into said cylinder and propulsion of said piston toward said second end, said element further having a second surface substantially opposite said first surface and said housing having a chamber adjacent said second surface; means for connecting said source to said chamber so that the fluid in said chamber assists said biasing means to maintain said element in said operative position; and means for establishing communication between said chamber and the atmosphere adjacent said chamber to thus reduce the pressure in said chamber and enable the fluid acting upon said first surface to move said element to said inoperative position.

5. A pneumatic implement for driving staples, nails and analogous fasteners, comprising a housing; a cylinder provided in said housing and having an open first end and a second end; a piston reciprocable in said cylinder and having means for driving a fastener in response to movement of the piston from said first toward said second end; a valve including a valving element adjacent said first end and movable in said housing between operative and inoperative positions in which said first end is respectively sealed and exposed, and means for biasing said element to said operative position; a source of pressurized gaseous fluid, said element having a first surface which is acted upon by fluid to move said element to said inoperative position with attendant penetration of fluid into said cylinder and propulsion of said piston toward said second end, said element further having a second surface substantially opposite said first surface and said housing having a chamber adjacent said second surface; means for connecting said source to said chamber so that the fluid in said chamber assists said biasing means to maintain said element in said operative position; and means for establishing communication between said chamber and the atmosphere adjacent said chamber to thus reduce the pressure in said chamber and enable the fluid acting upon said first surface to move said element to said inoperative position, said means for establishing communication including a second valving element which is installed in a portion of said connecting means and is movable therein exclusively by the fluid between a first position in which said source is free to admit fluid into said chamber and the fluid in said connecting means is sealed from the atmosphere and a second position in which said chamber is free to communicate with the atmosphere and said chamber is sealed from said source.

6. The implement of claim 5, further comprising means for effecting movements said second valving element between said positions, including a third valving element disposed in said connecting means between said source and said second valving element and means for moving said third element to a predetermined position in which said source communicates with said portion of said connecting means and the fluid is free to maintain said second element in said first position.

7. The implement of claim 6, further comprising means for moving said third element from said predetermined position to an additional position in which said third element seals said connecting means from said source and establishes communication between said connecting means and the atmosphere so that said second element is free to leave said first position.

8. The implement of claim 5, wherein said portion of said connecting means includes a cylindrical compartment for said second valving element, said second element having a channel which connects said source with said chamber in the first position of said second element, said housing having a port which connects said chamber with the atmosphere in the second position of said second element.

9. The implement of claim 8, wherein said second element has a cylindrical portion with a sealing member which engages the connecting means in said compartment, said second element being reciprocable between said first and second positions thereof.

10. The implement of claim 8, wherein said connecting means and said second element define an annular space forming part of said compartment and communicating with said chamber, said channel being in communication with said space at least in the first position and said port being in communication with said space in the second position of said second element.

11. The implement of claim 10, wherein said port is disposed at one axial end of said compartment and said second element is reciprocable in said compartment between said first and second positions thereof.

12. The implement of claim 11, further comprising an annular sealing member provided in said compartment and surrounding said port, said second element having a substantially conical end portion which sealingly engages said member in the first position of said second element.

13. The implement of claim 5, further comprising a sleeve surrounding said second element in said portion of said connecting means, said second element being reciprocable in said sleeve.

14. The implement of claim 5, further comprising a second valve provided in said connecting means between said source and said portion of said connecting means and operable to connect said portion with said source or with the atmosphere, said second element having a surface which is acted upon by fluid in said chamber to urge said second element to said second position and to actually move said second element to said second position when said second valve connects said portion of said connecting means to the atmosphere.

15. The implement of claim 5, wherein said biasing means comprises a ring-shaped spring.

16. The implement of claim 15, wherein at least a portion of said spring consists of a plastic material.

* * * * *